US007066281B2

(12) United States Patent
Grotendorst

(10) Patent No.: US 7,066,281 B2
(45) Date of Patent: Jun. 27, 2006

(54) FORMATION FLUID SAMPLING AND HYDRAULIC TESTING TOOL AND PACKER ASSEMBLY THEREFOR

(75) Inventor: Josef Grotendorst, Dorstem (DE)

(73) Assignee: EDM Systems USA, Albuquerque, NM (US)

( * ) Notice: Subject to any disclaimer, the term of this patent is extended or adjusted under 35 U.S.C. 154(b) by 216 days.

(21) Appl. No.: 10/606,051

(22) Filed: Jun. 25, 2003

(65) Prior Publication Data

US 2004/0118610 A1 Jun. 24, 2004

Related U.S. Application Data

(63) Continuation-in-part of application No. 10/187,302, filed on Jun. 28, 2002, now Pat. No. 6,662,644.

(51) Int. Cl.
*E21B 49/08* (2006.01)
*E21B 23/04* (2006.01)
*E21B 23/06* (2006.01)

(52) U.S. Cl. ..... 175/50; 73/152.28; 175/59; 175/230

(58) Field of Classification Search ..... 73/152.26–152.28, 152.19, 152.36, 152.22, 73/152.23, 152.46, 152.51, 152.54; 175/50, 175/59, 230
See application file for complete search history.

(56) References Cited

U.S. PATENT DOCUMENTS

| | | | | |
|---|---|---|---|---|
| 2,503,557 | A * | 4/1950 | McKinely | 73/152.23 |
| 3,248,938 | A * | 5/1966 | Hill et al. | 73/152.51 X |
| 3,799,260 | A * | 3/1974 | Barrington | 166/185 |
| 5,054,553 | A * | 10/1991 | Grotendorst | 166/278 |
| 5,095,745 | A * | 3/1992 | Desbrandes | 73/152.24 |
| 6,296,056 | B1 * | 10/2001 | Ward | 175/230 X |
| 6,343,650 | B1 * | 2/2002 | Ringgenberg | 175/230 X |
| 6,478,096 | B1 * | 11/2002 | Jones et al. | 175/50 |
| 6,568,487 | B1 * | 5/2003 | Meister et al. | 175/50 |
| 6,640,908 | B1 * | 11/2003 | Jones et al. | 175/50 |
| 6,871,713 | B1 * | 3/2005 | Meister et al. | 175/50 |
| 2004/0231408 | A1 * | 11/2004 | Shammai | 73/152.27 |
| 2004/0231842 | A1 * | 11/2004 | Shammai et al. | 166/264 |

* cited by examiner

*Primary Examiner*—Thomas P. Noland
(74) *Attorney, Agent, or Firm*—Robert W Becker & Associates; Robert W Becker

(57) ABSTRACT

A drilling apparatus that includes a formation fluid sampling and hydraulic testing tool for a drilling apparatus that includes a drilling string comprised of a drilling pipe and a drilling bit is provided. The tool is mounted on a string that comprises from top to bottom a pressure reduction valve, an expandible and collapsible packer bladder assembly, the sampling tool, and a lower expandible and collapsible packer bladder assembly, disposed between the drilling pipe and the drilling bit. Associated with the packer assemblies are pressure and vacuum storage devices for inflation and deflation respectively of the bladders of the packer assemblies.

10 Claims, 3 Drawing Sheets

FORMATION FLUID SAMPLING AND HYDRAULIC TESTING TOOL AND PACKER ASSEMBLY THEREFOR

RELATED APPLICATIONS

This is a CIP application of U.S. patent application Ser. No. 10/187,302, filed Jun. 28, 2002, and now U.S. Pat. No. 6,662,644.

BACKGROUND OF THE INVENTION

The present invention relates to a formation fluid sampling and hydraulic testing tool for a drilling apparatus that includes a drilling string comprised of a drilling pipe and a drilling bit. The present invention further relates to a method of drilling and sampling with such a drilling apparatus.

Formerly, to obtain a valid formation fluid sample such as oil, gas and/or water from single or multiple rock units within the earth, it was necessary to drill a borehole to the total depth, to run down-the-hole geophysical logs, to set casing cemented to the surface, to run a wireline shot-tool into the cased hole to a desired sampling location, to shoot holes through the casing and the cement-filled annular space behind the casing and into the formation, such that formation fluid can enter the interior of the casing, to set a straddle-packer across the shot zone, to insert a pumping device and pump the fluid out. The procedure of shooting the casing and setting a packer is repeated for as many formations as desired. If hydraulic testing is desired, a pressure transducer must be set between the upper and lower packers of a straddle packer set in the casing specifically for the purpose of isolating the interval to be tested from other parts of the cased hole and an electrical line connected to the pressure transducer must be run to the surface. These processes are costly and time consuming.

The former method has the further disadvantage that cracking of the cement in the annular space between the boreface and the steel casing can form a pathway for flow of formation fluids behind the casing resulting in possible cross-contamination and alteration of formation fluid pressures.

Alternatively side-wall sampling devices try to extract fluid samples from a formation behind the mud cake on the boreface. Such samples are usually contaminated by drilling fluid, and the criterion of pumping until constant pH and electrical conductivity are achieved cannot be obtained or the criterion for extracting highly pressured oil and gas cannot be carried out before the hole is cased and the packers properly set.

One effort for improving the aforementioned procedures was described in U.S. Pat. No. 5,054,553. However, this effort does not provide the desired time and cost savings.

It is therefore an object of the present invention to provide a formation fluid sampling and hydraulic testing tool that significantly reduces the time and cost involved in the acquisition of samples of fluids contained within subsurface rock strata without removing the drilling tools from a borehole. Such a tool should also allow the determination of hydraulic characteristics of these same subsurface rock strata, again without removing the drilling tools from the borehole, and should prevent possible cross contamination and/or uncontrolled alteration of fluid pressures and fluid flow and provide better information for design of any well completions.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
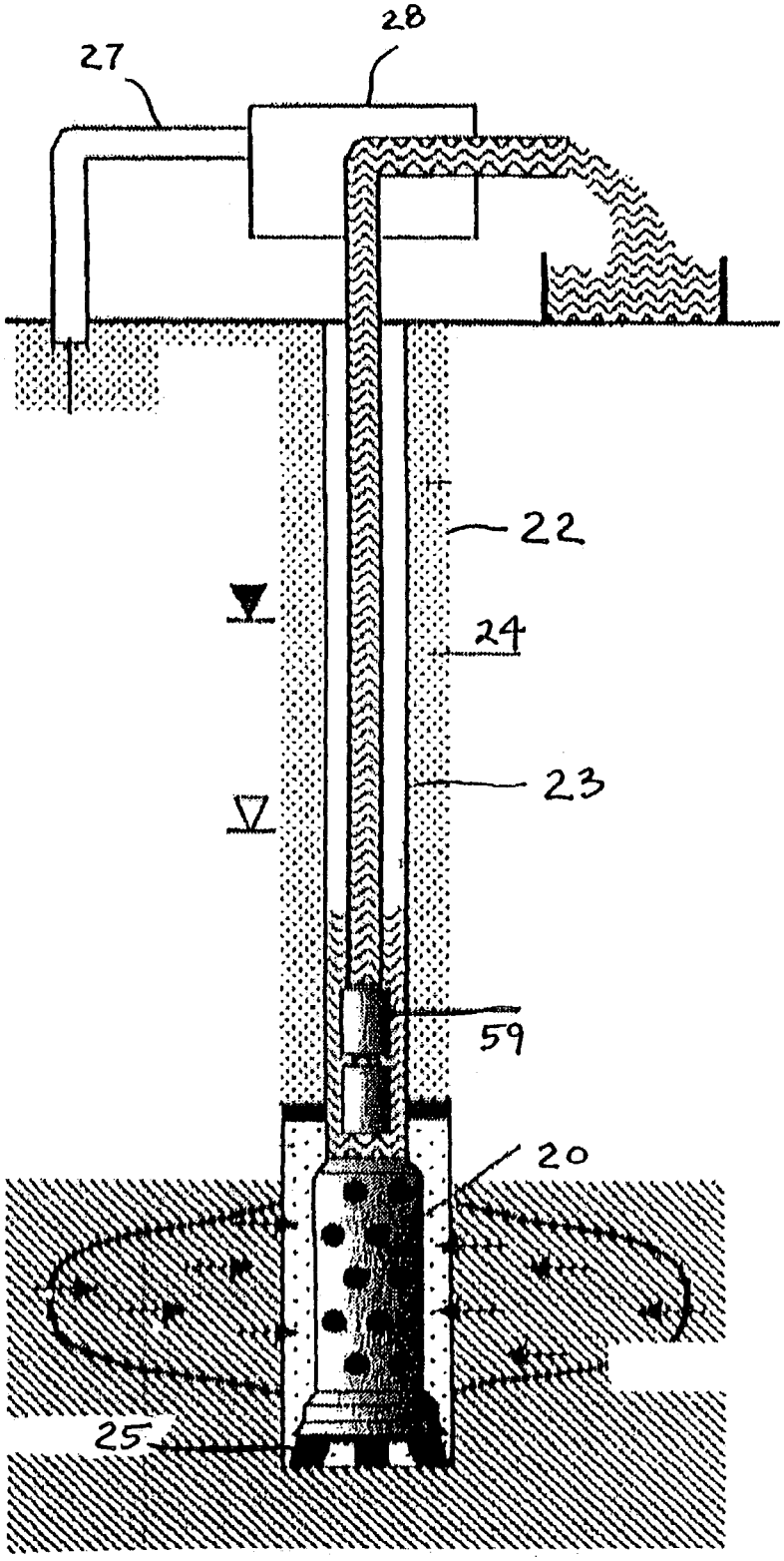
FIG. 1 illustrates a drilling apparatus setup that is provided with one exemplary embodiment of the inventive formation fluid sampling and hydraulic testing tool.

The formation fluid sampling and hydraulic testing tool of the present invention is characterized primarily by: an outer tube that is disposed between the drilling pipe and the drilling bit, with the outer tube being provided with a plurality of through holes for receiving a sample of formation fluid into the outer tube and permitting the flow of formation fluid into the interior of the tool and into the drill pipe; an inner tube that is disposed within, and spaced from, the outer tube to form an annular space between them, with the inner tube being provided with a plurality of through holes disposed at one end of the inner tube and adapted to communicate with the annular space, wherein such end of the inner tube is connectable to a pumping mechanism for drawing a sample of formation fluid through the through holes of the outer tube and the through holes of the inner tube; means for closing off or releasing the through holes of the inner tube; means for sealing the annular space from the open ends of the outer tube; and first and second valve means for establishing or closing off communication between the interior of the inner tube and the open ends of the outer tube.

As indicated above, pursuant to the present invention the formation fluid sampling and hydraulic testing tool is disposed between the drilling pipe and the drilling bit. The inventive tool fulfills two specific acts. It acts as a piece of drill pipe when drilling and passes the drilling fluid to the drilling bit for lubricating the latter and removing formation cuttings from a borehole while drilling and for conditioning the borehole. When a fluid sample is desired, drilling is terminated at the desired depth. A pumping mechanism is emplaced in the drilling pipe and drilling fluid is pumped out of the drilling pipe. In the case of the use of the tool for deep oil and gas exploration and testing activities, the tool has mounted above it a pressure reduction mechanism that prevents highly pressured oil and gas from blowing drilling fluid out of the interior of the drilling pipe either when the tool is first opened, or if, after some of the drilling fluid is pumped out, the formation pressure is greater than the bottom hole pressure of the drilling fluid in the drill pipe. This will be described in greater detail subsequently.

The pressure differential between the interior and exterior of the drilling string caused by the potentiometric head difference between the inside and outside of the drilling pipe actuates a plurality of valves and flaps within the inventive tool, which opens the through holes in the wall of the inner tube of the tool, allowing formation fluid to enter the tool and to be extracted by the pumping device or which allows highly pressurized fluid, whether water, oil or gas, to flow to the surface through a plurality of pressure reduction and flow control valves. In the case of oil, gas and/or water, the sample may be collected when the pH and the electrical conductivity stabilize. In the case of oil and gas and water produced with it, the sample is collected at the surface for determination of gas-oil-water ratios, viscosity, BTU values and other test parameters.

To obtain hydraulic information of the formation, a pressure transducer or other pressure sensing device is simply lowered inside the drilling pipe. Drawdown and recovery pressure or bottom-hole, shut-in, flowing-tubing, and buildup and final bottom hole pressure and other data can be easily obtained for determining undamaged aquifer transmissivity and/or a formation mobility ratio.

When sampling and testing are completed, the drilling pipe is filled with drilling fluid or, in the case of high pressure fluid zones, the well is shut-in and is overpressured. The overpressure causes reversal of the actuation of the packer assemblies above and below the inventive tool and of the valves and flaps within the tool, and drilling resumes until the next point of sampling and hydraulic testing. If a geophysical log is desired, it is obtained following completion of drilling.

From the foregoing, it can be seen that in contrast to heretofore known apparatus, the inventive formation fluid sampling and hydraulic testing tool eliminates the expense of casing the borehole and cementing it in place. Furthermore, the inventive tool eliminates the wire-line shot perforation process and the necessity for repeatedly emplacing and removing the straddle packer. The inventive tool also eliminates the possibility of cross-contamination between different zones in a perforated well caused by pressure differentials between the various fluid-filled rock formations in the subsurface.

Further specific features of the present invention will be described in detail subsequently.

DESCRIPTION OF PREFERRED EMBODIMENTS

Figure 2:
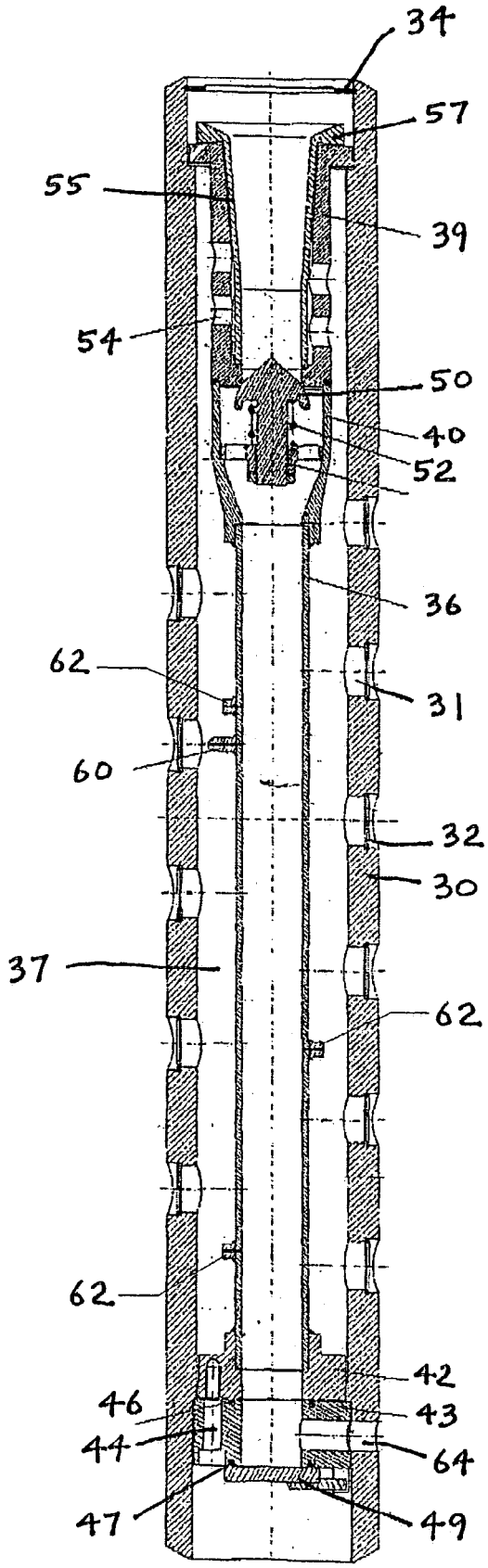
FIG. 2 is a detailed view of one exemplary embodiment of the inventive formation fluid sampling and hydraulic testing tool.

Referring now to the drawings in detail, FIG. 1 illustrates a drilling apparatus that is provided with the inventive formation fluid sampling and hydraulic testing tool, which is generally indicated by the reference 20. In particular, FIG. 1 schematically shows a drilling site, including a borehole 22 in which is disposed the drilling string, comprised of a drilling pipe 23 and stabilizers. An annular space 24 exists between the wall or boreface of the borehole 22 and the drilling pipe 23, and is appropriately stabilized, for example by the drilling fluid. For a mud-rotary or oil-based fluid-drilling operation, a drilling bit 25 is attached to the lower end of the apparatus, with the inventive sampling and testing tool 20 being disposed between the drilling string and the drilling bit 25. In operation, the inventive drilling tool is preferably equipped with packers above and below the tool. Above the upper packer assembly is a bi-directional pressure reduction valve that prevents overpressured formation fluid from uncontrollably blowing out of the drill pipe. The inventive tool is shown in detail in FIG. 2 and will be described in detail subsequently.

The annular space of the borehole 22 around the inventive sampling and testing tool 20, and slightly thereabove, is filled with drill cuttings of the material that has been drilled, which acts as a filter medium. During a drilling operation, drilling fluid is circulated through the system by being pumped from the surface, for example via the conduit or suction line 27 and the pump or unit 28, into the drilling string, through the inventive sampling and testing tool 20, and then to the bit 25. The drilling fluid subsequently enters the annular space 24 and rises to the surface, where it is recirculated and pumped back into the drilling string. The pressure exerted by the fluid pressure in the annular space 24 and the drill pipe 23 is maintained higher than the pressure within formations by the drilling fluid pumps at the surface. Blow-out of drilling fluid in the annular space by unexpected high pressure zones is controlled by a surface mounted blow-out preventer. Blow-out through the drill pipe is controlled by shut-in valves of the return line to the drilling fluid pump.

The sampling and testing tool 20 of the present invention includes an outer tube 30 that is provided with a plurality of through holes 31 through the wall of the tool. In one specific embodiment of the present invention, a total of fifty-five through holes 31 are provided. In particular, ten rows of such holes, with each row being provided with five or six through holes 31, are provided. Filters 32, for example made of stainless steel screen, are disposed in each of the holes 31. A sealing ring 34 or the like is disposed at the upper end of the outer tube 30 to provide a seal between the tool 20 and the drilling string or pipe 23 thereof.

Disposed in the apertured outer tube 30 is an inner tube 36 that is spaced from the outer tube to form an annular space 37 between them. Appropriate means are provided for sealing the annular space 37 from the open ends of the outer tube 30.

In particular, such sealing means includes a flanged sleeve 39 and a valve housing 40 that adjoin one another and extend from the upper end of the inner tube 36 to near the open upper end of the outer tube 30. At the opposite, lower end of the inner tube 36, there are provided flange means 42, 43 that are disposed on the outer tube 30 and the inner tube 36 respectively and are interconnected with one another, for example via appropriate screws 44. In addition, a sealing means, such as an O-ring 46, can be provided between the two flange means 42 and 43. A further sealing means, such as the O-ring 47, can be disposed between the flange means 43 and a lower valve flap 49 that either closes off the lower end of the inner tube 36, or allows communication between the interior of the inner tube 36 and the lower open end of the outer tube 30.

Similarly, the upper end of the inner tube 36 can either be closed off or open for communication with the upper end of the outer tube 30. In particular, a valve means in the form of a valve cone 50 is biased by the spring 52 against the flanged sleeve 39. The valve cone 50 is supported in the valve housing 40. In addition, the flanged sleeve 39 is provided with a plurality of through holes 54 that are open to the annular space 37. Communication between the annular space 37 and the open upper end of the outer tube 30 is made possible by these through holes 54. In addition, such communication can be blocked by means of the sleeve 55, which is embodied as a conical sleeve and is provided with flanges 57 that rest upon the flanged sleeve 39.

A very critical feature and distinct advantage of the inventive sampling and testing tool 20 is that the tool no longer has an inner filling of gravel or the like. Such a filling, with its inherent drawbacks, is of course undesirable, and the need therefore has been completely obviated with the inventive tool.

The drilling apparatus, and in particular the inventive sampling and testing tool 20, operate as follows. For a normal drilling operation, as mentioned above, drilling fluid is pumped into the drilling pipe 23. In so doing, the drilling fluid enters the upper open end of the outer tube 30, and presses the valve cone 50 downwardly. Because the drilling fluid is at a pressure of, for example, 25 bar, it easily opens the valve cone 50, which is biased with a pressure of only, for example, 2-3 bar. The drilling fluid then passes through the inner tube 36, and presses against the, for example spring-loaded, lower valve flap 49, which is biased in a closed position at 4-5 bar. The drilling fluid then passes through the open lower end of the outer tube 30, and drives and lubricates the drilling bit 25. Subsequently, the drilling fluid passes up the annular space through the gravel or other suitable fill around the tool 20, and enters the annular space 24.

It should be noted that during such normal drilling operation, the sleeve 55, which is pressed down by the pressure of the drilling fluid, securely closes off the through holes 54.

To now obtain a sample at the level of the sampling and testing tool 20, the flow of drilling fluid is halted. As will be discussed in detail subsequently, packer bladders are expanded to contact the boreface of the borehole 22 making a secure contact. As a result of the halting of drilling fluid, the lower valve flap 49 as well as the valve cone 50 close. A pumping mechanism 59 (FIG. 1) is submerged into the drilling pipe 23 and some of the drilling fluid that is in the drilling pipe is pumped out. This results in an underpressure in the inventive tool, as a consequence of which the sleeve 55 is raised, thereby freeing and exposing the through holes 54. Thus, a formation fluid that is to be sampled, such as, by way of example only, water, oil, gas, or other mineral-containing fluid, can now enter the annular space 37 through the through holes 31 in the outer tube 30. The formation fluid then passes through the through holes 54 and can be pumped out of the open upper end of the outer tube 30 to a collecting site on the surface.

If the formation fluid is overpressured with regard to the drilling fluid in the drill pipe, a pressure reduction valve (see FIG. 3) situated above the packer and inventive tool assembly automatically drops the fluid pressure such that as it exits the drill pipe at the surface, its flow rate can be conveniently controlled and samples taken.

Normal drilling operation can now be immediately resumed. To do so, the packer assembly is deflated and the submerged pumping mechanism 59 is removed or otherwise brought out of the drilling pipe 23. Drilling fluid is again pumped into the drilling pipe 23, thereby pushing the sleeve 55 down and tightly against the through holes 54. The valve cone 50 and the lower valve flap 49 are again opened due to the pressure of the drilling fluid, and the drilling string and bit 25 are rotated and drilling is resumed.

The sampling and testing tool 20 is furthermore provided with a plurality of nozzles 60, one at each of the through holes 31, which operate continuously during a drilling operation. In particular, the nozzles 60 are directed against the filters 32 to clean them by rinsing filter cake, which consists of the drilled material and solids in the drilling fluid, from these filters so that the through holes 31 are kept open. To simplify illustration of FIG. 2, only one such nozzle 60 has been shown.

A further advantage of the inventive sampling and testing tool 20 is that, in contrast to the heretofore known methods, where a gravel filter had to be artificially placed, it is now possible to eliminate the need for the gravel filter by using the inflatable packer bladders above and below the tool for the isolation of the formation to be sampled and tested.

It is also to be understood that the inventive sampling and testing tool 20 can be provided in multiple sections in order to have a tool of the desired length.

As indicated above, the valve cone 50 should be closed during a sampling operation in order to prevent sediment from contaminating the sampling. However, if for some reason the valve cone 50 does not close properly, and sediment enters the inner tube 36, thereby closing it off for further use, due to the thickness of the sediment, the increasing pressure from the drilling fluid will open safety valves 62 that are spaced along the inner tube and are directed into the annular space 37. In the illustrated embodiment, three such safety valves 62 are provided. Such safety valves open at, for example, a pressure of 25 bar, and again rinse off the outer filter cakes of drilling material that is on the filters 32. A drilling operation can then proceed normally.

With regard to the lower valve flap 49, this valve, which is moveably mounted to either the outer tube 30 or the inner tube 36, for example via one of the flanges 42 or 43, is biased at a greater pressure than is the valve 50 as a further safety measure.

In the event that the drilling bit 25 is not operating, for example because the lower valve flap 49 cannot open, further safety measures in the form of valves 64 are provided at the lower end of the inventive tool 20. For example, three such valves 64 can be provided. These valves operate as follows, and are biased, for example, at 25 bar. If, for example, the lower valve flap 49 will not open, the pressure of the drilling fluid increases until the valves 64 are opened. These valves then effect a rinsing-off of the filter cake from the outside of the valve flap 49 so that it can again open and the drilling operation can resume.

Most of the components of the inventive sampling and testing tool 20, with the exception of the O-rings, are made of stainless steel, such as the steel having the designation V4a, which is prescribed by DIN1.45.71. On the other hand, the conical sleeve 55 is preferably made of aluminum.

Figure 3:
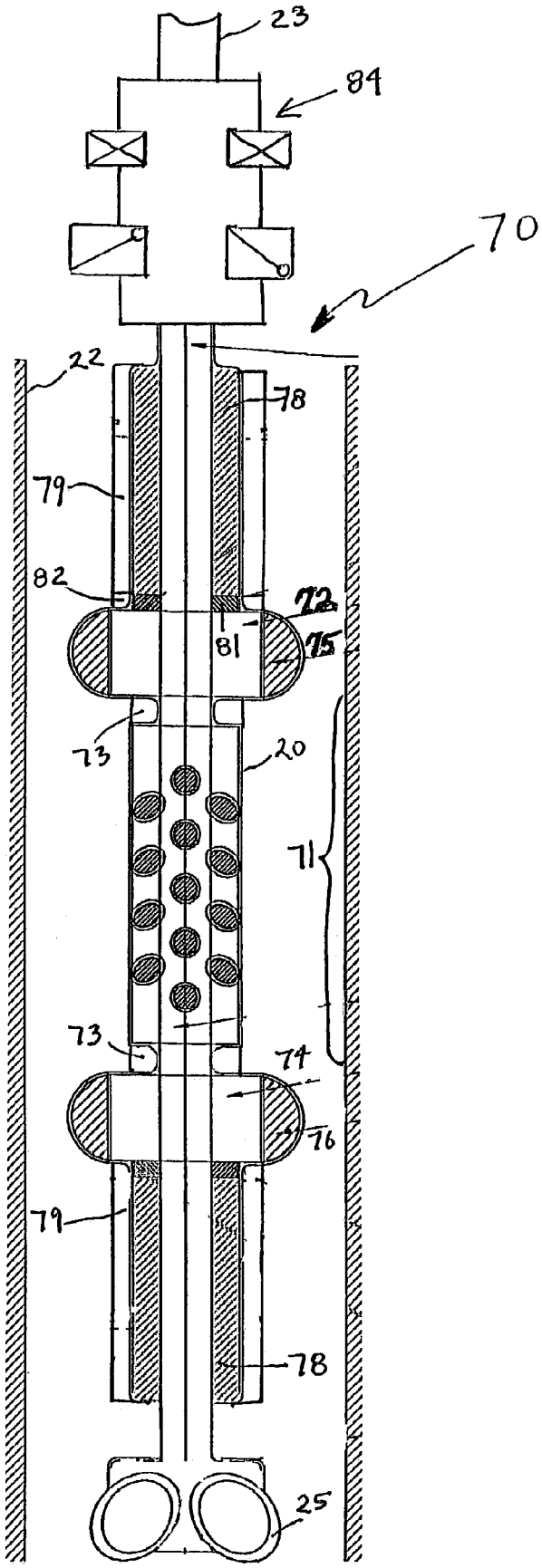
FIG. 3 shows packer members and associated pressure and vacuum storage means therefore.

Pursuant to the present invention, when the sampling and testing tool 20 is to be used for deep oil and gas exploration and testing, for example at depths greater than 1000 feet, the system indicated generally in FIG. 3 by the reference numeral 70 is proposed. Parts of this embodiment that are the same as those described in connection with FIGS. 1 and 2 have the same reference numerals.

In the embodiment of FIG. 3, the drill string is comprised of the drilling bit 25 above which is placed an in-line packer arrangement that straddles the tool 20 and is used to isolate a section 71 of fluid-containing rock formation that is to be sampled and hydraulically tested. This inventive in-line packer arrangement comprises a first packer member 72 disposed above the tool 20, and preferably a second packer member 74 disposed below the tool 20. The packer members 72 and 74 are illustrated very schematically, and can have any appropriate length. The packer members are actuated by the pressure differences between the drilling fluid inside the drill string and the drilling fluid in the annular space 24 between the boreface of the borehole 22 and the drilling pipe 23 (see FIG. 1). The operation of the packer members 72 and 74 will be explained in greater detail subsequently.

Disposed above and below the tool 20 in the drill string are through-going pressure-activated, packer-protecting safety valves 73. These valves 73 include time-measurement-mechanisms that control the duration that the valves remain open, after which the valves close. The valves 73 lead to passages within the packer members 72 and 74, and into the exterior of the drill string above the lower packer member 74 and below the upper packer member 72. When the pressure-activated safety valves 73 sense that the pressure difference between the drilling fluid in the annular space 24, and the formation section 71 that is being tested, exceeds the strength of the packer members, the valves open and allow drilling fluid from within the annular space 24 into the space between the packer members 72, 74 that is occupied by the tool 20. This allows pressure equalization across each packer member and protects the packer members from damage that could even prevent their extraction from the borehole 22.

The packer members 72 and 74 are provided with expandable or inflatable membranes or bladders 75 and 76 respectively. Pressure and vacuum storage means are provided for the extension, or inflation, and the retraction or deflation, of the packer member bladders toward and away from the boreface of the borehole 22 to essentially isolate the formation section 711 that is to be sampled.

In particular, disposed below the lower packer member 74, and above the upper packer member 72, within the drill string, are especially constructed, so-called "energy strings". In a presently preferred embodiment, the drilling pipe 22 is embodied as two concentric volumetric spaces 78 and 79 surrounding a standard drill pipe and each connected by the pressure-sensitive valve means 81 and 82 to their respective packer members 72 and 74. Each volumetric space 78 is for compressed air, high-pressure gas, such as nitrogen, or some other appropriate medium, and each volumetric space 79 contains a vacuum. Upon reduction of the fluid level or the pressure within the drill string, the pressure-sensitive valves 81 that connect the packer members with the high pressure volumetric spaces 78 are actuated, possibly with time delay, and open. High pressure gas from the volumetric spaces 78 feeds into the packer members 72 and 74 and inflates the bladders 75 and 76 thereof against the boreface of the borehole 22. The actual pressure of the gas or other medium filling the packer bladder 75 and 76 is calculated based on the outside diameter of the collapsed packer members and the gauge diameter of the drilled borehole, as well as the expected pressure difference across the packer members 72 and 74 when the borehole fluid is extracted from within the drill string or the well begins to flow.

Upon completion of a pumping or testing procedure, the drilling pipe 23 is shut in at the surface, and as the pressure difference between the inside of the drilling string and the fluid column in the annular space 24 returns to equilibrium, or as the pressure of the fluid in the drill string is overpressured, the pressure-sensing valves 81 that provide communication between the high pressure volumetric spaces 78 and the associated packer member 72 and 74 are closed, while the pressure-actuated valves 82 between the vacuum spaces 79 and the packer members 72 and 74 are opened, thereby allowing the high pressure gas in the expanded packer bladders 75 and 76 to escape into the vacuum volumetric spaces 79 under the compressive force of the collapsing packer bladders. When the packer bladders 75 and 76 of the packer members 72 and 74 have collapsed to their original position, drilling can be resumed. As the pressure inside and outside of the drilling string equilibrates, or the pressure within the drilling string is over pressured, the valves and flaps within the tool 20 also close and complete drilling fluid circulation is resumed. The amount of high pressure gas or other medium contained within the high pressure volumetric spaces 78 is designed to be sufficient to conduct several separate formation fluid sampling and hydraulic testing tests before it is necessary for the drilling string to be extracted and the volumetric spaces to be recharged with vacuum and high pressure gas respectively. This is a critical advantage of the present invention over prior known devices, because with the inventive drilling apparatus, it is no longer necessary to extract the drilling string, install formerly used test equipment, or to use packers, every time a sample is to be taken.

It should be noted that in place of the concentric volumetric spaces for the high pressure gas and for the vacuum, it would also be possible to provide additional "energy strings", including, for example, long cylinders that contain high pressure gas and vacuum respectively.

In addition to the packer members 72 and 74, and the unique triple-walled "energy strings" or the volumetric spaces 78 and 79, there is disposed above the upper triple-wall assembly, in the drill string, a bi-directional pressure reduction valve 84. This bi-directional pressure reduction valve serves to regulate maximum pressures within the inventive assembly that actuate the pressure-sensitive valves and the valves and flaps within the tool 20. The pressure reduction valve 84 additionally serves as a blow-out preventer that controls the pressure of any fluid that might tend to flow under high formation pressure to the land surface. In oil and gas operations, the drilling fluid and the annular space pressure are controlled by a standard surface blow-out preventer. The bi-directional pressure reduction valve 84 serves as a blow-out preventer within the drill string itself.

The present invention is, of course, in no way restricted to the specific disclosure of the specification and drawings, but also encompasses any modifications within the scope of the appended claims.

The invention claimed is:

1. A drilling apparatus that includes a drilling string comprised of a drilling pipe, in a borehole, and a drilling bit, said apparatus comprising:

a formation fluid sampling and hydraulic testing tool disposed in said drilling string and below said drilling pipe;

a first packer member disposed about said drilling pipe in said borehole above said sampling and testing tool; and means associated with said first packer member for effecting extension and retraction of said first packer member to and from sides of said borehole, wherein said first packer member includes a bladder that is adapted to be expanded and deflated to effect extension and retraction respectively of said first packer member, wherein said means for effecting extension and retraction includes a pressure storage means containing a pressurized gas or other medium, and a vacuum storage means, wherein a first valve is associated with said pressure storage means and a second valve is associated with said vacuum storage means, wherein said first valve is adapted to release compressed gas from said pressure storage means to effect expansion of said bladder and hence extension of said first packer member, and wherein said second valve is adapted to subject said bladder to vacuum and hence to effect retraction of said first packer member.

2. A drilling apparatus that includes a drilling string comprised of a drilling pipe, in a borehole, and a drilling bit, said apparatus comprising:

a formation fluid sampling and hydraulic testing tool disposed in said drilling string and below said drilling pipe:

a first packer member disposed about said drilling pipe in said borehole above said sampling and testing tool; and means associated with said first packer member for effecting extension and retraction of said first packer member to and from sides of said borehole, wherein said first packer member includes a bladder that is adapted to be expanded and deflated to effect extension and retraction respectively of said first packer member, wherein said means for effecting extension and retraction includes a pressure storage means containing a pressurized gas or other medium, and a vacuum storage means, wherein said means for effecting extension and retraction is in the form of two concentric tubular members disposed about said drilling pipe, wherein one of said tubular members forms said pressure storage means, and wherein the other of said tubular members forms said vacuum storage means.

3. A drilling apparatus that includes a drilling string comprised of a drilling pipe, in a borehole, and a drilling bit, said apparatus comprising:

a formation fluid sampling and hydraulic testing tool disposed in said drilling string and below said drilling pipe;

a first packer member disposed about said drilling pipe in said borehole above said sampling and testing tool:

means associated with said first packer member for effecting extension and retraction of said first packer member to and from sides of said borehole; and a bi-directional pressure reduction valve mechanism is disposed about said drilling pipe, above said first packer member, for controlling pressure in the drilling pipe and the testing tool.

4. A drilling apparatus according to claim 3, wherein said first packer member includes a bladder that is adapted to be expanded and deflated to effect extension and retraction respectively of said first packer member.

5. A drilling apparatus according to claim 4, wherein said means for effecting extension and retraction includes a pressure storage means containing a pressurized gas or other medium, and a vacuum storage means.

6. A drilling apparatus according to claim 5, wherein a first valve is associated with said pressure storage means and a second valve is associated with said vacuum storage means, wherein said first valve is adapted to release compressed gas from said pressure storage means to effect expansion of said bladder and hence extension of said first packer member, and wherein said second valve is adapted to subject said bladder to vacuum and hence to effect retraction of said first packer member.

7. Drilling apparatus according to claim 6, wherein a second packer member is disposed about said drilling pipe in said borehole below said sampling and testing tool, and wherein further means are associated with said second packer member for effecting extension and retraction of said second packer member to and from sides of said borehole.

8. A drilling apparatus according to claim 7, wherein said second packer member includes a bladder that is adapted to be inflated and deflated to effect extension and retraction respectively of said second packer member.

9. A drilling apparatus according to claim 8, wherein said means for effecting extension and retraction includes a pressure storage means containing a pressurized gas or other medium, and a vacuum storage means.

10. A drilling apparatus according to claim 9, wherein a first valve is associated with said pressure storage means and a second valve is associated with said vacuum storage means, wherein said first valve is adapted to release compressed gas from said pressure storage means to effect inflation of said bladder and hence extension of said second packer member, and wherein said second valve is adapted to subject said bladder to vacuum and hence to effect retraction of said second packer member.

* * * * *